United States Patent [19]

Boisture

[11] Patent Number: 5,067,558

[45] Date of Patent: Nov. 26, 1991

[54] MULTI-LANCE TUBE CLEANING SYSTEM

[75] Inventor: Thomas B. Boisture, Baytown, Tex.

[73] Assignee: Ohmstede Mechanical Services, Inc., Baytown, Tex.

[21] Appl. No.: 600,485

[22] Filed: Oct. 19, 1990

Related U.S. Application Data

[63] Continuation-in-part of Ser. No. 490,776, Mar. 8, 1990, Pat. No. 5,002,120.

[51] Int. Cl.[5] ..... F22B 9/08

[52] U.S. Cl. ..... 165/95; 15/317; 122/379; 122/391; 134/166 C; 134/167 C

[58] Field of Search ..... 122/379, 391, 392; 15/316 R, 316 A, 317; 165/95; 134/166 C, 167 C

[56] References Cited

U.S. PATENT DOCUMENTS

| | | | |
|---|---|---|---|
| 620,224 | 2/1899 | Bubser . | |
| 1,694,371 | 12/1928 | Burdick | 15/104.05 |
| 1,796,878 | 3/1931 | Watson | 134/24 |
| 2,494,380 | 1/1950 | Ellig | 134/168 |
| 2,604,358 | 7/1952 | Richards | 299/47 |
| 3,269,659 | 8/1966 | Shelton et al. | 239/187 |
| 3,589,388 | 6/1971 | Haneline, Jr. | 137/315 |
| 3,600,225 | 8/1971 | Parmelee | 134/24 |
| 3,794,051 | 2/1974 | Lee, Jr. et al. | 134/46 |
| 3,817,262 | 6/1974 | Caradeur et al. | 134/167 |
| 3,901,252 | 8/1975 | Riebe | 134/56 |
| 3,903,912 | 9/1975 | Ice, Jr. et al. | 134/167 |
| 3,938,535 | 2/1976 | Cradeur et al. | 134/167 |
| 4,095,305 | 6/1978 | Goodwin | 15/104.1 |
| 4,107,001 | 8/1978 | Kinzler | 202/241 |
| 4,199,837 | 4/1980 | Fisco, Jr. | 15/302 |
| 4,234,980 | 11/1980 | DiVito et al. | 15/302 |
| 4,322,868 | 4/1982 | Wurster | 15/302 |
| 4,422,210 | 12/1983 | Bergsand et al. | 15/302 |
| 4,503,811 | 3/1985 | Hammond | 122/392 |
| 4,543,711 | 10/1985 | Wada et al. | 29/726 |
| 4,547,963 | 10/1985 | Ohmstede | 29/726 |
| 4,669,145 | 6/1987 | Kear | 134/166 C X |
| 4,750,547 | 6/1988 | Sakamoto | 165/95 X |
| 4,805,653 | 2/1989 | Krajicek et al. | 134/166 C |
| 4,856,545 | 8/1989 | Krajicek et al. | 134/166 |

OTHER PUBLICATIONS

Single and Multi Rotating Lance Bundle Cleaner Drawings: Hydrovac Industrial and Petroleum Services, Ltd., 1/22/88, 2/2/88, 4/2/88.

Dow Sales Brochure for Jet-Cleaning Heat Exchanger Tubes with Mini-Lancer Service, 2/2/88.

Weatherford Water Jetting Systems, Heat Exchanger Tube Lancing Machine, Apr. 1988.

Hydrovac International, Ltd., Sales Brochure, Date Unknown.

Browning Ferris Industries Chemical Services, Inc., No Date, pp. RC 1007-1009, Date Unknown.

6/1971 Cesco, Inc. Annual Report, pp. 8-9.

Cesco Scene, Cesco, Inc., Company Newsletter, Date Unknown.

Cesco Scene, Cesco, Inc., Company Newsletter, p. RC-1058, Date Unknown.

R. Lee, R. Torbin, R. Bell, "State of the Art Mechanical Cleaning of Heat Exchangers", Oct. 1985, American Society of Mechanical Engineers, pp. 7-8.

J. Twigg, "High-Pressure Water Jetting Techniques", Corrosion Prevention and Control, Apr. 1982.

*Primary Examiner*—Edward G. Favors

*Attorney, Agent, or Firm*—Pravel, Gambrell, Hewitt, Kimball & Krieger

[57] ABSTRACT

A multi-lance cleaning apparatus for cleaning the interior of heat exchanger tubes, the apparatus having a lance housing, a slidable manifold within the lance housing, a single conduit connecting the manifold with a high pressure, high volume fluid source, a spool for storing the conduit permitting it to be advanced and retracted, means for moving the manifold within the housing, a conduit securing and supporting assembly, a plurality of lances removably attached to the manifold and adapted to fit within a heat exchanger tube and tube guides to guide and support the lances. The apparatus further includes a means for positioning the housing with respect to a heat exchanger tube bundle to be cleaned.

20 Claims, 6 Drawing Sheets

200
202
204
206
208
210
211
212
214
215
216
218
220
222
224
226
234
236
238
250
252
254
260
262
264
266
268
270
272
274
276
100
102
103
104
105
106
108
126
131
132
136
140
142
4
5
6
8

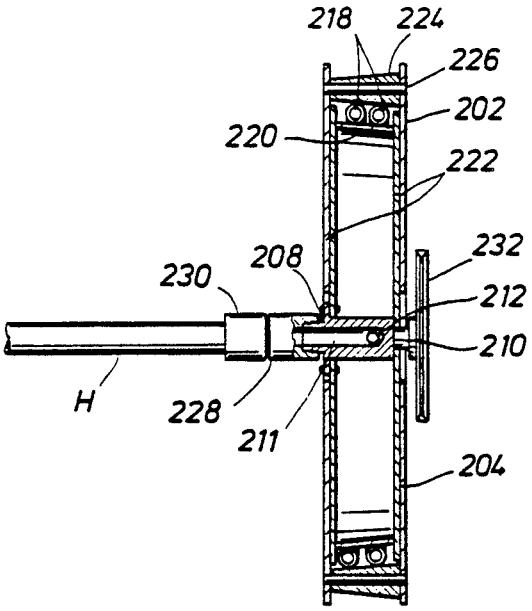
FIG. 5
FIG. 6
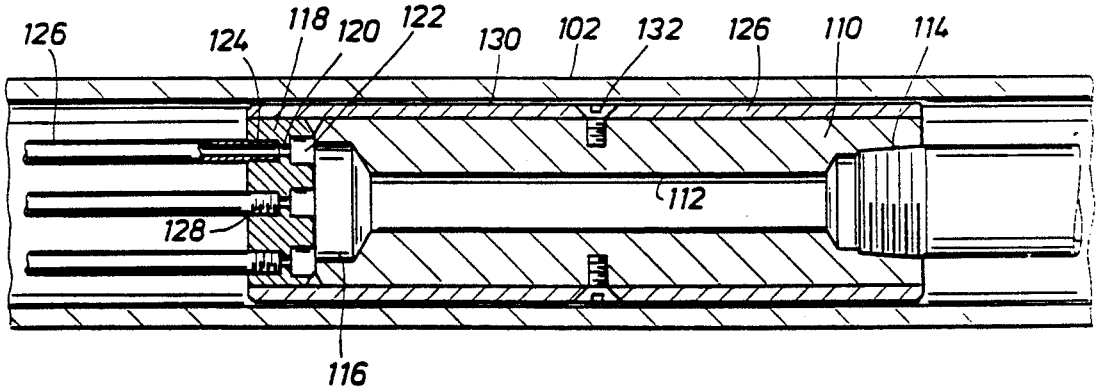
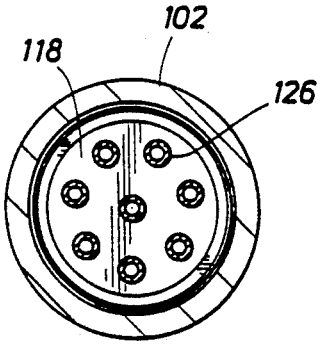
FIG. 7

FIG. 9
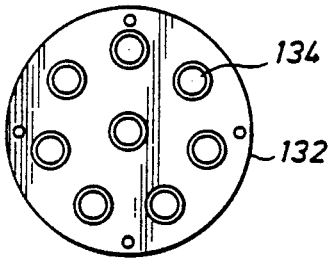
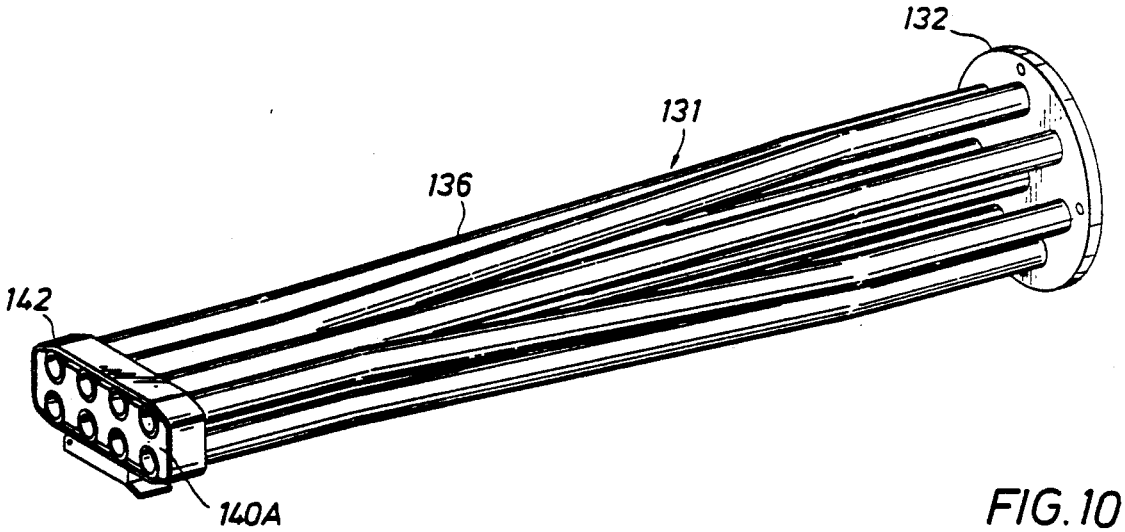
FIG. 10
FIG. 11
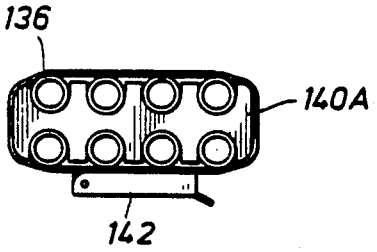
FIG. 12
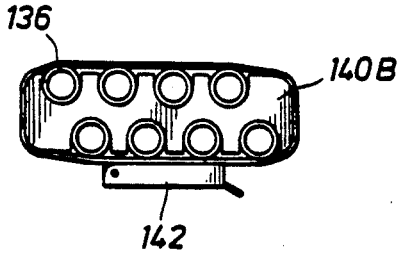

MULTI-LANCE TUBE CLEANING SYSTEM

This Application is a continuation-in-part of U S. Application Ser. No. 490,776, filed Mar. 8, 1990, now U.S. Pat. No. 5,002,120 for a MULTI-LANCE TUBE CLEANING SYSTEM. The inventor listed in the present application was a named inventor in Application Ser. No. 490,776 now U.S. Pat. No. 5,002,120.

BACKGROUND OF THE INVENTION

1. Field of the Invention

The present invention relates to an apparatus for cleaning the interior of tubes used in heat exchanger bundles. More particularly, the present invention relates to an apparatus capable of simultaneously cleaning the interior of several tubes within a heat exchanger bundle on site.

2. Description of the Prior Art

Heat exchanger tube bundles are used for the transfer of heat from a fluid media passing through a series of conduits. During this process, carbonaceous and calcareous deposits will form on the interior of the individual tubes and debris and other dirt will collect on the surface of the individual tubes. Therefore, in order to maintain efficient operation, it is necessary to periodically remove the tube bundles and clean the interior and exterior of the tubes.

One method of cleaning the interior of heat exchanger tubes includes the progressive insertion of a small diameter tube, known as a lance, into the heat exchanger tube and pumping high pressure water through the lance to clean the interior of the tube. The water pressure in a lance may easily exceed 10,000 psi and flow rates in excess of 100 gallons per minute. Prior art devices called for the lance to be manually operated and advanced into the heat exchanger tube. It will be appreciated that the manual operation of a lance is unsatisfactory for a number of reasons. First, the operator is required to overcome the force of the water pressure when inserting the lance into the tube. Further, should the lance wall rupture, an operator may be injured by the high pressure water flow. Similarly, an operator may be injured by backsplash from the lance during the insertion of the lance in the tube. Lastly, the manual operation of a lance is time consuming and costly as only one lance may be used in manual operations.

Various mechanical devices have been used in an effort to overcome the above deficiencies in cleaning the interior of heat exchanger tubes. U.S. Pat. No. 3,903,912 to Ice, Jr. et al. discloses a multiple lance cleaning system, including lance positioning and drive means and exposed lance tubes. However, the use of exposed lance tubes continues to pose a danger to an operator should a lance wall rupture. U.S. Pat. No. 3,817,262 to Caradeur et al. also discloses a multiple lance cleaning system having a lance positioner and drive system and exposed lance tubes. However, as in the Ice disclosure, the operator is still exposed to the danger of potential lance tube rupture.

U.S. Pat. No. 3,901,252 to Riebe discloses a multiple lance system including a lance drive and enclosed lance tubes, manifold and water lines. However, Riebe does not disclose a lance positioning system capable of readily positioning the lances and lance drive into a multitude of tubes within the heat exchanger bundle nor does it disclose a system for retracting the water pressure line. U.S. Pat. No. 4,856,545 to Krajicek et al. disclosed a multi-lance tube cleaning system having a lance drive means, lance tubes and manifold and multiple high pressure water lines within an enclosed structure. The disclosure called for the cleaning structure to be positioned by a crane mounted on a truck or by other mobile crane, tractor or skid. However, there are a number of disadvantages, i.e., as the lances are moved forward the center of gravity of the structure may shift which could result in misalignment and unnecessary stress on the lance tubes.

Accordingly, there exists a need for an improved tube bundle cleaner having enclosed tube lances, means for transporting water to the lances and for accurately supporting and positioning the lances during operation, means for retracting the water pressure line in an efficient and thorough manner and means for securing and supporting the water pressure line. While there are other disclosures directed to the cleaning of the interior of heat exchanger bundles (such as U.S. Pat. Nos. 3,589,388; 2,494,380; 1,694,371; and 620,224), none disclose or suggest a multi-lance cleaning system having enclosed lances, manifold, means for securing and supporting the water pressure line, and an independent means for positioning the lance cleaning system.

SUMMARY OF THE INVENTION

The present invention relates to a multi-lance apparatus for cleaning the interior of tubes within a heat exchanger tube bundle having an elongate housing, a moveable high pressure water manifold within the housing, a single conduit connecting the manifold to a high pressure high volume water source, means for securing and supporting the conduit, and means for storing the conduit. The apparatus further includes a plurality of lances removably connected to the manifold, means for moving the manifold within the housing and means for supporting and guiding the lance tubes during operations and storage. The present invention also includes a means for positioning and supporting the housing with respect to a tube bundle to be cleaned.

BRIEF DESCRIPTION OF THE DRAWINGS

A better understanding of the present invention may be had by reference to the following drawings and contained numerals therein of which:

FIG. 5 is a cross-sectional view taken along line 5—5 of FIG. 3 showing the spool portion of the preferred embodiment;

FIG. 6 is a cross-sectional view taken along line 6—6 of FIG. 3 showing the manifold portion of the preferred embodiment;

FIG. 7 is an end view of the manifold portion of the preferred embodiment;

FIG. 9 is an end view of the indexing assembly and guide tubes of the present invention;

FIG. 10 is a perspective view of the indexing assembly of the present invention;

FIG. 11 is an end view of a square forward guide plate in the indexing assembly of the present invention; and FIG. 12 is an end view of a triangular forward guide plate in the indexing assembly of the present invention.

DETAILED DESCRIPTION OF THE INVENTION

Figure 1:
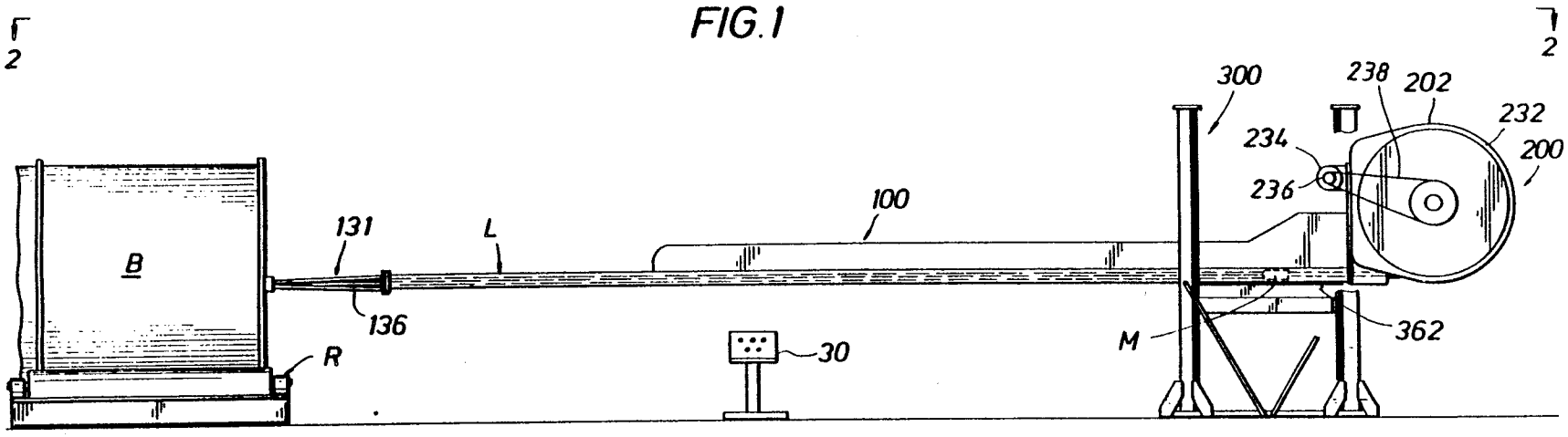
FIG. 1 is an elevational view of the preferred embodiment.
Figure 2:
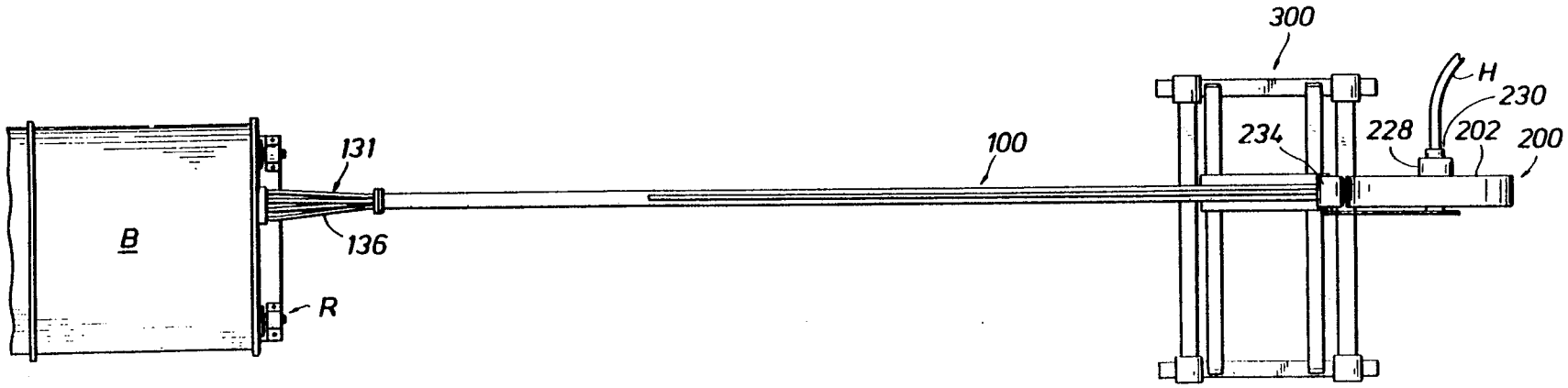
FIG. 2 is a top view of the preferred embodiment.

FIGS. 1 and 2 are side and top views of the preferred embodiment of a multi-lance tube cleaning system as disclosed in U.S. patent application No. 490,776. A tube bundle "B" is disposed on rollers which are part of a tube bundle support and rotating device "R." The device "R" is disclosed in pending U.S: patent application No. 489,001. Lance assembly 100 is shown in close proximity to tube bundle "B." A plurality of hollow, high strength lances "L" are generally shown as being disposed in the lance assembly 100. A lance indexing assembly 131 is shown affixed to the end of the lance assembly 100, adjacent to the tube bundle "B." Further, the lances "L" are shown as being in communication with a manifold "M" within the lance assembly 100. Spool assembly 200 is removably attached and in close proximity to lance assembly 100. The spool assembly 200 is used to store a high pressure flexible water line or conduit 218 (FIG. 3) which is in communication with manifold "M" in lance assembly 100. The spool assembly 200 is itself connected to a high pressure, high volume water source by means of hose "H" as shown in FIG. 2. The lance assembly 100 and the spool assembly 200 are supported by a positioner assembly 300 which supports and positions the lance assembly 100 and spool assembly 200 relative to the tube bundle "B" to be cleaned. The positioner assembly 300 is capable of moving the lance assembly 100 and spool assembly 200 horizontally (or laterally) and vertically. A detailed description of one embodiment of the positioner assembly 300 which can be used with the present invention is included in the parent of the present application, U.S. patent application No. 490,776, filed on Mar. 8, 1990, whose entire specification is hereby incorporated by reference as if fully set forth herein. Also shown in FIG. 1 is a remote control pendant 30. The control pendant 30 is intended to control a high pressure water source and hydraulic fluid flow used to position and power the present invention. While the remote control pendant may be configured to control any suitable high pressure water source and hydraulic flow, it is contemplated that the present invention, including the remote control pendant 30 has been specifically configured to operate with the high pressure water source and hydraulic pressure source described in U.S. patent application No. 489,001, hereinafter referred to as the "water pressurizing unit." Further, the control pendant 30 in the present invention is interconnected with the positioning and spool assemblies 300 and 200 in a like manner as the remote control pendant described in U.S. patent application No. 489,001.

Figures 3, 4:
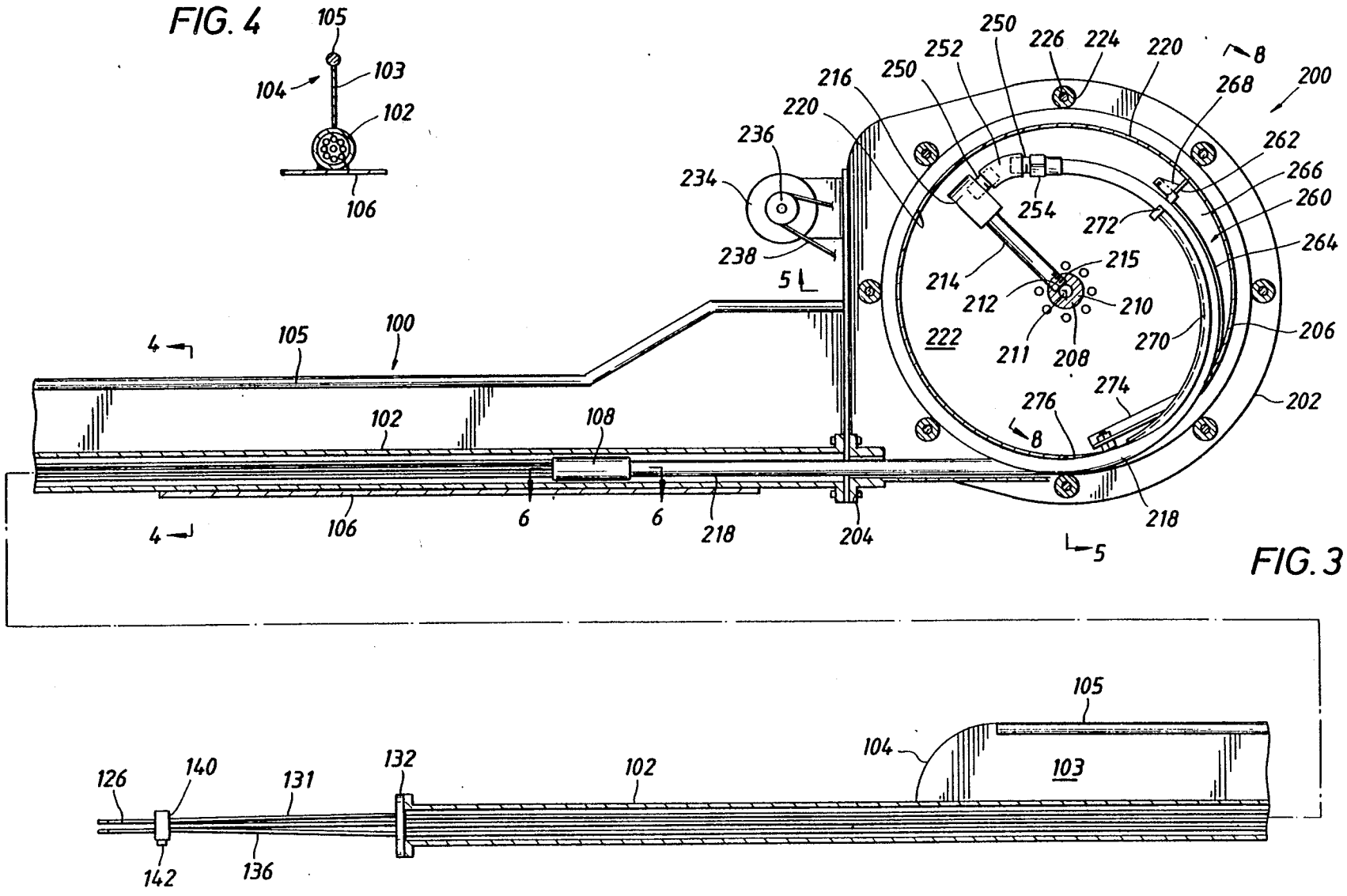
FIG. 3 is a cross-sectional view of the tube cleaning apparatus and spool portion with conduit securing and supporting assembly of the preferred embodiment.
FIG. 4 is a cross-sectional view taken along line 4—4 of FIG. 3 showing the tube cleaning apparatus of the preferred embodiment.

Referring to FIG. 3, lance assembly 100 and spool assembly 200 are shown. With reference to lance assembly 100, a hollow elongate housing 102 is affixed to a shorter base 104 which comprises a web 103 and a top 105. In the preferred embodiment, cross-sectional housing 102 is shown as cylindrical in cross-section (See FIG. 4). However, it is understood that the cross-section of housing 102 may vary without departing from the spirit of the invention. In the preferred embodiment, base 104 is shown as being welded to housing 102. Base 104 is adapted to be removably attached to a carriage beam 362, depicted in FIG. 1. The base 104 may be attached to the carriage beam 362 by means of nuts and bolts, latches or other suitable mechanical means.

An elongate support member 106 is affixed to housing 102 opposite base 104. Support member 106 rests on carriage beam 362. A manifold 108 is slidably mounted in housing 102.

Referring to FIG. 6, manifold 108 is comprised of a central metal body 110 having an axial bore 112 therethrough. One end of bore 112 is adapted to be removably connected to a high pressure water line. It is understood that any references to water as a high pressure cleaning fluid is meant to include water, a cleaning fluid, or any soluble combination thereof. All further references to water are meant to include such cleaning fluids. Body 110 includes a sealing thread 114 in the central bore 112. Opposite the threaded end of body 110, a coaxial counterbore 116 is machined in bore 112. A lance plate 118 is mounted adjacent to the machined counterbore 116 and in sealing contact with body 110. Lance plate 118 may be maintained adjacent to manifold body 110 by means of drilled and tapped holes or other suitable mechanical means. Lance plate 118 includes a plurality of apertures 120 passing therethrough and a plurality of counterbores 122 adjacent to body 110. The lance plate counterbores 122 are adapted to mate with the counterbore 116 in body 110 such that the lance plate holes 120 are in fluid communication with manifold central bore 112. The lance plate 118 further includes internal threads 124 adapted to receive lances 126 and mate with threads 128 thereon. It is contemplated that the internal diameter of lance plate holes 120 is approximately equal to the inside diameter of lances 126. The lance plate 118 and body 110 are fitted into a manifold shield 130, which is made from a suitable low friction material, such as teflon-coated nylon. The manifold shield 130 is retained to the manifold body 110 by means of machine screws 133.

Referring back to FIG. 3, lances 126 are thereby removably attached and in fluid communication with manifold 108. Lances 126 have relatively thin walls and are manufactured from a high strength stainless steel or other suitable material. Lances 126, when mated with manifold 108, are approximately the length of housing 102. The lance assembly 100 further includes an indexing assembly 131, discussed further below, which is located approximately three to four feet from the end of the housing 102 which is proximate tube bundle "B" as shown in FIGS. 1 and 2.

It will be appreciated that the size of a heat exchanger tube and the manner in which the tubes are arranged within a tube bundle affect the required spacing between the tubes. Consequently, it is necessary that the multi-lance tube cleaning system be capable of adjustment for various tube sizes and spacing. The tube orientation within a tube bundle is generally either of a "square" or "triangular" pitch or alignment. Accordingly, it is necessary to align the lances 126 with the tube alignment. In order to accomplish this objective, the present invention includes an indexing assembly which is adapted to compensate for variations in tube size and orientation.

Referring now to FIGS. 9 and 10, the indexing assembly 131 includes a rearward indexing guide plate 132. The indexing guide plate 132 is mounted external and coaxial to housing 102 in a suitable mechanical manner. The guide plate 132 has a plurality of apertures 134 passing therethrough. The pattern formed by the guide plate holes 134 is similar to that found in lance plate 118 (see FIG. 7); however, guide plate holes 134 are of a sufficient diameter to permit lances 126 to pass through. Guide plate holes 134 are adapted to receive a plurality of guide tubes 136 which have sufficiently large internal diameter to permit lances 126 to pass through. Guide tubes 136 may be affixed to guide plate 132 in any suitable fashion. As shown, the guide tubes 136 are threaded and engage matching threads in guide plate holes 134. Guide tubes 136 are bent to alter the pattern or "pitch" and the spacing between adjacent tubes 136 to match that of the tubes within tube bundle "B."

However, the angle of the bend along the centerline of guide tubes 136 is sufficiently small to permit lances 126 to pass through the guide tube 136 bend Without unduly stressing the walls of, or plastically deforming, lances 126. A second forward guide plate 140A which is adapted to reflect either square or triangular pitch and tube diameter for the particular tube bundle "B" being cleaned is fitted between guide tubes 136. In FIG. 10, forward guide plate 140A is shown as having a square pitch and is further depicted in FIG. 11. The second guide plate 140A is retained about guide tubes by suitable mechanical means. As shown, guide plate 140A is retained by means of a strap clamp 142 which encircles plate 140A. FIG. 12 illustrates a forward guide plate 140B having a triangular pitch. Thus, the present invention may be readily adjusted for variations in tube bundle size and orientation in a relatively short period of time. Further, as guide tubes 136 are substantially parallel to the centerline of the housing 102, the centerline of lances 126 as they enter the tubes are substantially parallel to the axis of the tubes to be cleaned. Accordingly, lances 126 are less likely to be damaged during cleaning operations which call for the lances 126 to be offset from their original centerline.

Figure 3A:
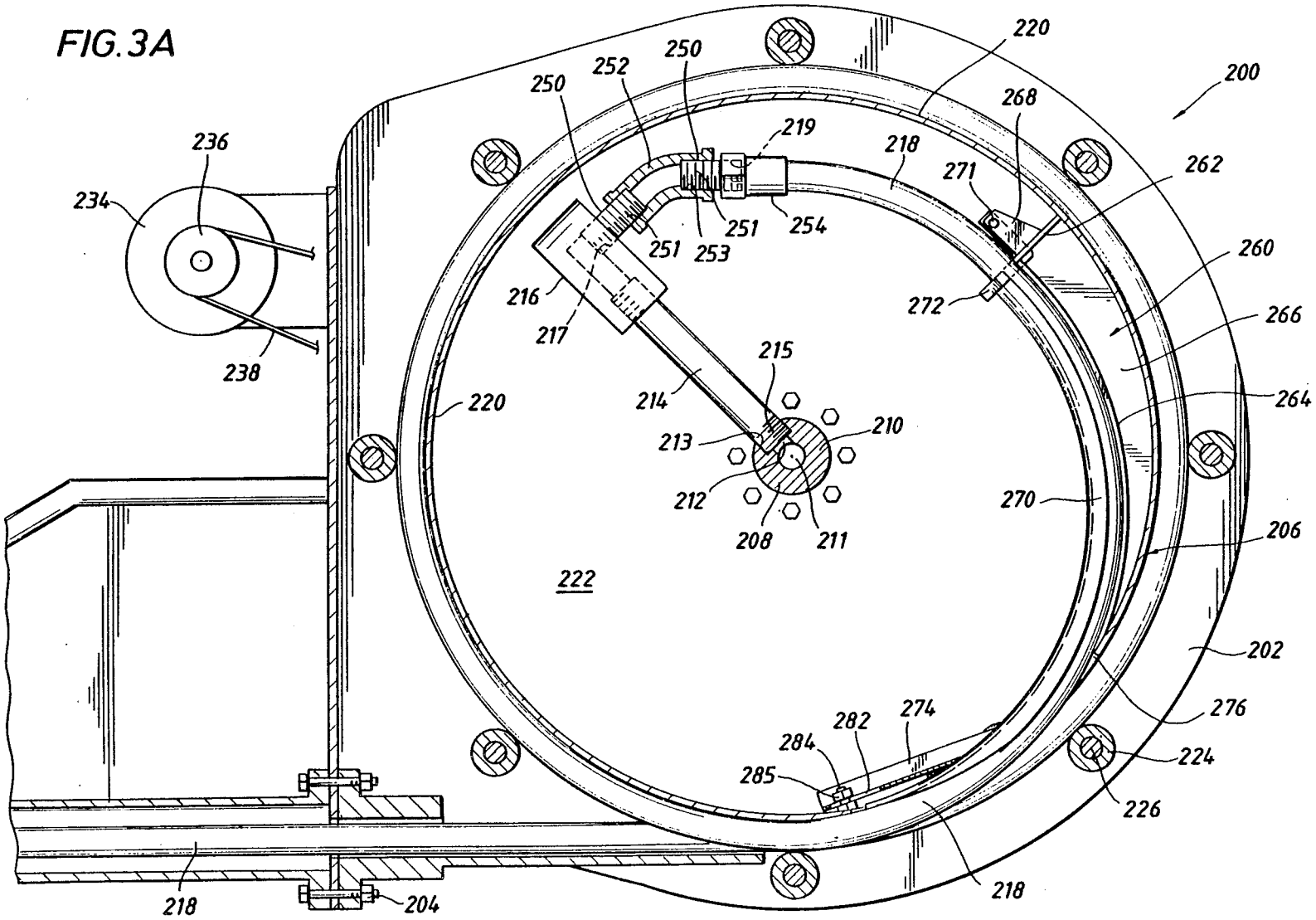
FIG. 3A is an enlarged cross-sectional view of a portion of FIG. 3 showing the spool portion with conduit securing and supporting assembly.

Referring now to FIGS. 1, 2, 3, 3A and 5 and with particular reference to FIGS. 3, 3A and 5, the present invention also includes a spool assembly 200 for the storage of the high water pressure hose 218 used to provide water under pressure to lances 126. Spool assembly 200 comprises a housing 202 which is removably fixed to lance housing 102 and support member 106. In the illustrated embodiment, spool housing 202 is secured to housing 102 by means of nuts and bolts 204. Rotatably mounted in spool housing 202 is spool 206. Spool 206 comprises a spindle 208, shaft 210, circumference plate 220 and side plates 222. Spool spindle 208 further includes a blind hole 211 therein along the longitudinal axis of spindle 208 and a radial passageway 212 therethrough. Blind hole 211 and radial passageway 212 are in fluid communication with each other. The radial passageway 212 is adapted to be removably connected to a water pipe 214 which is itself connected to union 216. Radial passageway 212 includes internal threads 213 adapted to sealingly mate with threads 215 on pipe 214. A high pressure water hose 218 having a swivel end 254 with internal threads 219 is adapted to sealingly mate with union 216 via a pair of short pipe nipples 250 and a 45° pipe elbow 252. The short pipe nipples 250 include external threads 251 adapted to sealingly mate with internal threads 217, 253, 219 of the union 216, pipe elbow 252 and the water hose 218, respectively. External threads 251 of one short pipe nipple 250 engage internal threads 217 of the union 216 and internal threads 253 of the pipe elbow 252. The second short pipe nipple 250 threadingly engages the water hose 218 and the pipe elbow 252. The pipe nipples 250 and pipe elbow 252 permit the water hose 218 to be more easily connected to the union 216. The water hose 218 is a semi-rigid high pressure water hose capable of pressures in excess of 10,000 psi. A typical water pressure hose 218 would be Model 4025 ST or equivalent manufactured by Rogan-Shanley, Inc. of Houston.

As may be seen in FIG. 5, water hose 218 is reeled onto the spool 206 and is retained by spool circumference plate 220 and side plates 222. The hose 218 is but a single hose; it appears to be a double hose in FIG. 5 because it is wrapped twice around the spool since the view is taken along line 5—5 of FIG. 3. Hose 218 is retained by a plurality of fixed rollers 224 mounted within spool housing 202. As illustrated, the rollers 224 are rotatably mounted on pins 226 which are affixed to housing 202. Further, the surfaces of rollers 224 and plate 220 are angled to encourage the hose 218 to wrap around plate 220 in an adjacent manner rather than on top or otherwise tangle up. Thus, the hose 218 is reeled and retained about spool 206 without exceeding the minimum bend radius for hose 218. Affixed to spool spindle 208 is a rotating union 228 (FIG. 2) which is removably connected to union 230 which is itself connected to a high pressure water source through hose "H." Referring to FIGS. 1 and 3, coaxially affixed to spindle 208 is spool shaft 210. Mounted on spool shaft 210 is a drive pulley 232. Mounted external to spool housing 202 is a hydraulic motor 234 having a drive pulley 236. Motor drive pulley 236 and spool drive pulley 232 are in rotational communication by means of drive belt 238. It is understood that the embodiment includes the use of drive gears and an endless chain to accomplish the transfer of rotational movement from motor 234 to spool 206. Further, motor 234 may be mounted external to spool housing 202 in a manner such that a motor drive gear would be in direct rotating contact with a drive gear mounted on spool shaft 210.

When hydraulic drive motor 234 is activated, the spool 206 is caused to rotate, thereby extruding or retracting hose 218. As may be seen in FIG. 3, hose 218 travels out of spool housing 202 and into the lance housing wherein it is removably connected to the manifold body 110 (FIG. 6). Thus, lances 126, manifold 108 and hose 218 are in fluid communication with each other. Further, as hose 218 is semi-rigid, it serves in the illustrated embodiment to advance and retract manifold 108, thereby advancing and retracting lances 126. Accordingly, the illustrated embodiment provides for a common means of storing the high pressure water hose 218 and moving lances 126.

Figure 8:
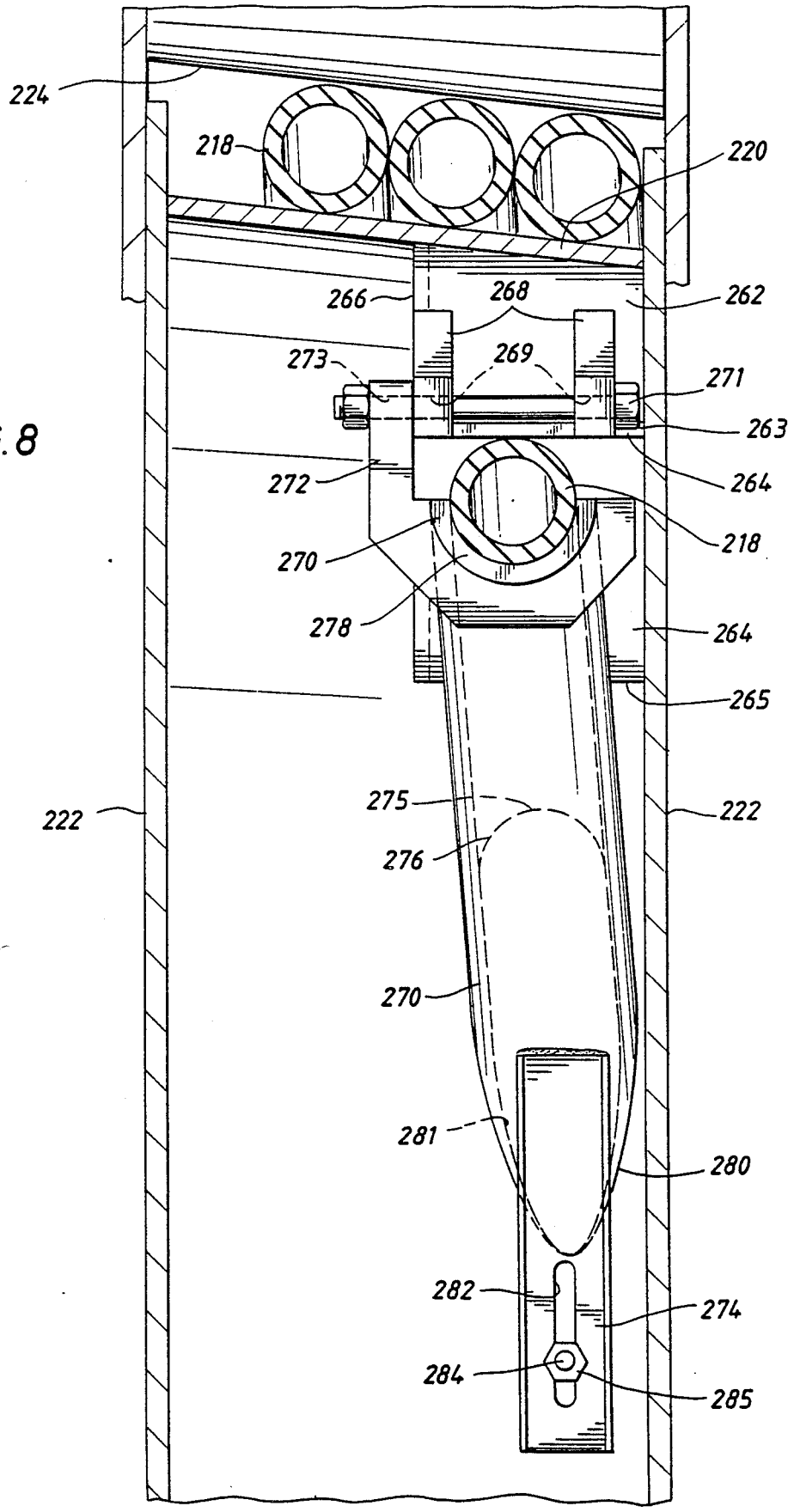
FIG. 8 is a detailed sectional view taken along line 8—8 of FIG. 3 showing the conduit securing and supporting assembly of the present invention.

Referring now to FIGS. 3, 3A and 8, the improvement of the multi-lance tube cleaning system consisting of a securing and supporting assembly 260 for the water hose 218 is illustrated. The securing and supporting assembly 260 is comprised primarily of an end plate 262, a curved plate 264, a box plate 266, a pair of clamp brackets 268, a hose saddle 270, a pivoting clamp 272 and a slide support 274. As stated above, the water hose 218 is semi-rigid and serves to advance and retract the manifold 108 and lances 126. Furthermore, according to the illustrated embodiment, the water hose 218 is wrapped twice on the spool circumference plate 220 prior to entering the interior of the spool assembly 200. An elongated aperture 276 in the spool circumference plate 220 permits the water hose 218 to enter the interior of the spool assembly 200. The elongated aperture 276 is shaped to allow a smooth, gradual transition of the water hose 218 from the outer surface of the spool circumference plate 220 to the interior of the spool assembly 200.

The securing and supporting assembly 260 has a box-like structure comprised of the end plate 262, the curved plate 264 and the box plate 266. The curved plate 264 is bent to a radius substantially the same as the spool circumference plate 220 to provide a gradual transition for the water hose 218. The end plate 262 is attached by any suitable means, preferably by welding, to a first end 263 of the curved plate 264. The box plate 266 is attached to the curved surface of the curved plate 264 and also to the end plate 262. The pair of clamp brackets 268 each have an aperture 269 passing therethrough. The pair of clamp brackets 268 are attached by suitable means to the end plate 262. The apertures 269 are properly aligned so that a clamp fastener 271 may be inserted through the aligned apertures 269. The clamp fastener is shown as a hexagonal head bolt and nut but is not limited to this type of fastener. The curved plate 264/end plate 262/box plate 266/clamp brackets 268 assembly is then attached to a spool side plate 222 and the spool circumference plate 220 forming a box-like structure inside the spool assembly 200. A second end 265 of the curved plate 264 is positioned substantially adjacent a first end 275 of the elongated aperture 276 to permit a gradual, smooth transition for the water hose 218 from the interior to the exterior of the spool assembly 200.

A second part of the securing and supporting assembly 260 consists of the hose saddle 270 having the same radius of curvature as the curved plate 264. The hose saddle 270 is made from a pipe which is longitudinally cut in half; the pipe having an inside diameter substantially the same as the outside diameter of the water hose 218. After the pipe is cut in half it is bent to the desired radius and shape to form the hose saddle 270. A first end 278 of the hose saddle 270 is attached to the pivoting clamp 272. The pivoting clamp 272 is generally L-shaped and has an aperture 273 at a pivoting end of the clamp 272. The clamp fastener 271 is inserted through the clamp aperture 273 and the aperture 269 of the clamp brackets 268.

As shown in FIG. 8, a second end 280 of the hose saddle 270 is contoured to substantially match a second end 281 of the elongated aperture 276 in the spool circumference plate 220. The slide support 274 is attached near the second end 280 of the hose saddle 270. The slide support 274 is shown as an angle iron having an elongated slot 282 formed in the leg of the slide support 274 which is in contact with the spool circumference plate 220. A slide bolt or stud 284 is attached to the inner surface of the circumference plate 220. The elongated slot 282 is placed over the slide stud 284 prior to threading a nut 285 on the slide stud 284 which secures the slide support 274 to the circumference plate 220. The water hose 218 is positioned in the hose saddle 270 and held firmly between the hose saddle 270 and the curved plate 264. By firmly holding the water hose 2!8, the hose 218 is protected from adverse forces experienced by the hose 218 as the lances are advanced and retracted. The hose securing and supporting assembly 260 supports the hose 218 along the interior of the spool assembly 200 and provides a smooth, gradual transition as the hose 218 passes through the spool circumference plate 220.

When installing or replacing the water hose 218, the clamp fastener 271 and the nut 285 on the slide stud 284 are loosened which permits the pivoting clamp 272 to pivot around the clamp fastener 271 as the slide support 274 slides in the elongated slot 282. This allows ample area for the hose 218 to be inserted through the elongated aperture 276 and then be fed between the hose saddle 270 and the curved plate 264. After the hose swivel end 254 has passed through the pivoting clamp 272 and has been threaded onto the short pipe nipple 250, the hose saddle 270 with the water hose 218 resting therein is forced outwardly until the water hose 218 is securely held against the curved plate 264. The clamp fastener 271 and the slide stud nut 285 are then tightened which secures and supports the water hose 218. It should be mentioned that the elongated aperture 276 and the pivoting clamp 272 are sized so that the hose swivel end 254 may pass through without disassembly or difficulty.

Operation of the Present Invention

Due to the weight and size of heat exchanger tube bundles, it is necessary to clean the tube bundles on site. Accordingly, it is necessary to transport the present invention to a job site for operations. The present invention including lance assembly 100, spool assembly 200 and positioner assembly 300 may be transported to the job site by any suitable means. It is contemplated that the present invention will be transported to a job site on a trailer as disclosed in U.S. patent application No. 489,001. Further, while the present invention may be used in conjunction with any high pressure, high volume fluid source, it is contemplated that the present invention will be used in conjunction with the invention disclosed and claimed in U.S. patent application No. 489,001.

Upon arriving at the job site, the positioner assembly 300 is removed from the trailer by means of a crane assembly as disclosed in U.S. patent application No. 489,001 and positioned normal to the end of a tube bundle "B" to be cleaned. The remote control pendant 30 is removed from its transport vehicle and positioned to permit the operator to observe lancing operations while maintaining a safe distance from the high-pressure lances. The lance housing 100 and spool housing 200 are then mounted on carriage beam 362 of the positioner assembly 300 utilizing a suitable lifting and placement means, such as the crane disclosed in U.S. patent application No. 489,001 or any other suitable means. The lance and spool assemblies 100 and 200 are then secured to the carriage beam 362. The operator inspects the tube bundle spacing and selects the forward guide plate 140A/B which best corresponds with tube bundle size and spacing. The forward guide plate 140A/B is inserted around guide tubes 136, into mount 138 and secured with strap clamp 142.

A flexible hydraulic hose is used to interconnect the spool hydraulic drive motor 234 with a suitable hydraulic pressure source. The spool assembly 200 is in communication with a high pressure water source by means of a hose H which is connected to union 230. The lances 126 are thus in fluid communication with the high pressure water source (not shown) through hose 218 and manifold 108. The lance and spool assemblies 100 and 200 are then positioned with respect to the tube bundle tubes by the selective application of hydraulic pressure to positioning motors (not shown) of positioner assembly 300. Hydraulic pressure to spool drive motor 234 feeds out hose 218 and advances manifold 108 which in turn advances lances 126. The lances 126 advance out of the housing 102, through the first guide plate 132 and into the guide tubes 136. The lances 126 are thus indexed to the proper centerlines for individual tubes within tube bundle "B" when the lances exit forward guide plate 140A/B and enter tube bundle "B." The high pressure water source is activated by the operator causing the high pressure water to flow through hose H, hose 218, into manifold 108 and out lances 126 into the individual tubes. The lances 126 continue to advance into the tubes, cleaning deposits away from the inside. Should one of the lances 126 encounter an obstruction it is unable to clean away, the excess water pressure will be channeled into the remaining lances 126 through manifold 108 counterbore 116. Further, a commercial needle valve (not shown) may be placed in the hydraulic line powering hydraulic motor 234 to limit hydraulic pressure. When a lance 126 encounters an obstruction, if the water pressure or the forward motion of the lance 126 does not dislodge the obstruction, the needle valve will prevent the motor 234 hydraulic pressure from increasing. By limiting the pressure, the apparatus according to the present invention prevents the lances 12 from buckling when attempting to clear the obstruction.

The present invention, when used in conjunction with a suitable means for supporting and rotating the tube bundle "B," such as that disclosed in U.S. patent application No. 489,001, is thus capable of cleaning the interior of all tubes within a tube bundle by positioning the lances vertically and horizontally. Further, a single operator is capable of positioning the lance and spool assemblies !00 and 200 and controlling the water flow from remote control pendant 30. Thus, a single operator is capable of carrying out multi-lance cleaning operations.

Further, the apparatus of the present invention may be used independent of the positioning and support assembly 300. It is contemplated that the lance and spool assemblies 100 and 200 may be lifted and positioned vertically, by a crane, frame or other suitable mechanical means, permitting the lances 126 to project downward as they are advanced within the housing 102. Thus, lance and spool assemblies 100 and 200 may be used to clean tube bundles which, for reasons of size or weight, must be cleaned in a vertical position. Flexible hydraulic lines are connected to spool drive motor 234 to advance the hose 218, manifold 108 and lances 126 in the vertical position. Further, a flexible high pressure hose H may be used to provide a conduit for high pressure water.

The description given herein is intended to illustrate the preferred embodiment of the present invention. It is possible for one skilled in the art to make various changes to the details of the apparatus without departing from the spirit of this invention. Therefore, it is intended that all such variations be included within the scope of the present invention as claimed.

What is claimed is:

1. A multi-lance cleaning apparatus for cleaning the interior of heat exchanger tubes comprising:

an elongate hollow housing having first and second ends;

a hollow manifold slidably moveable within said housing, said manifold having a plurality of interconnected channels and outlets;

a conduit for connecting said manifold with a high pressure, high volume fluid source, said conduit having a first end and a second end, said first end of said conduit being adapted to be removably connected to said manifold and said second end of said conduit being adapted to removably connected to a high pressure, high volume fluid source;

a spool for storage of said conduit to permit said conduit to advance and retract, said spool storage being in close proximity to said first end of said housing;

means for securing and supporting said conduit within said spool;

means for moving said manifold within said housing from a first retracted position to a second extended position;

a plurality of hollow tubular lances, the outer diameter of each said lance being adapted to fit within a heat exchanger tube, said lance having a first end and a second end, said first end of each said lance being removably attached to said manifold and in communication with said fluid source, said second end of said lance being in proximity to said second end of said housing, said lances moving in response to the movement of said manifold;

means for supporting and guiding the movement of said lances; and means for supporting and positioning said second end of housing and said second end of said lances with respect to a heat exchanger tube bundle to be cleaned.

2. The apparatus according to claim 1, wherein said means for securing and supporting said conduit includes:

a box-like structure attached to the interior of said spool, said box-like structure having a curved plate surface;

a saddle having a first end and a second end, said first end including a pivoting clamp which is pivotally attached to said box-like structure and said second end including a support member which is slidably attached to said spool; and wherein said conduit rests in said saddle and is secured and supported between said curved plate surface and said saddle.

3. The apparatus according to claim 2, wherein said saddle comprises a pipe longitudinally cut in half having an internal diameter substantially the same as the outside diameter of said conduit, said saddle having a curvature substantially similar to said curved plate surface.

4. The apparatus according to claim 3, wherein said pivoting clamp and said support member permit said conduit to be installed without removal of said saddle.

5. The apparatus according to claim 1, wherein said support and guide means comprises:

a first guide plate having a plurality of apertures adapted to support said lances, said first guide plate being interposed proximate to said housing's second end;

a plurality of guide tubes, said guide tubes being removably attached to said first guide plate and radially offset from said first guide plate to permit said lances to pass therethrough; and a second guide plate having a plurality of apertures corresponding to the tube bundle to be cleaned and adapted to be removably mounted on said second end of said elongate housing.

6. The apparatus according to claim 1, wherein said spool storage comprises:

a spool housing adapted to be removably connected to said elongate housing;

a spool rotatably mounted within said spool housing, said spool having a spindle, said spindle having a drive shaft on one end and a rotatable high pressure union mounted on the other end of said spindle, said second end of said conduit being removably connected to said spool;

a plurality of idler rollers, said rollers being rotatably mounted within said housing and in proximity to said spool; and a means for rotating said spool.

7. The apparatus according to claim 6, wherein the means for rotating said spool comprises:

a drive gear mounted on the shaft of said spool spindle;

a hydraulic motor, said motor having an output shaft and a drive gear mounted thereon; and means for coupling the output of said hydraulic motor to said spool drive gear.

8. The apparatus according to claim 7, wherein said coupling includes an endless drive chain connecting said motor drive gear and said spool drive gear.

9. A multi-lance cleaning apparatus for cleaning the interior of heat exchanger tube bundles comprising:

an elongate cylindrical hollow housing having first and second ends and a support member mounted thereto;

a hollow manifold slidably moveable within said housing, said manifold having a plurality of interconnected channels and outlets;

a semi-rigid high pressure water hose, having first and second ends, said first end being adapted to removably connect said manifold with a high pressure, high volume fluid source;

a spool for storage of said hose to permit said water hose to advance and retract;

means for securing and supporting said hose to said spool;

a plurality of hollow tubular lances, the outer diameter of said lances being adapted to fit within a heat exchanger tube, said lance having a first end and a second end, said first end being removably attached to said manifold and in communication with said fluid source, said second end of said lance being in proximity to said second end of said housing; and means for supporting and positioning said second end of said housing and said second end of said lances with respect to a heat exchanger bundle to be cleaned.

10. The apparatus according to claim 9, wherein said means for securing and supporting said hose includes:

a box-like structure attached to the interior of said spool, said box-like structure having a curved plate surface;

a saddle having a first end and a second end, said first end including a pivoting clamp which is attached to said box-like structure and said second end including a support member which is slidably attached to said spool; and wherein said hose rests in said saddle and is secured and supported between said curved plate surface and said saddle.

11. The apparatus according to claim 10, wherein said saddle comprises a pipe longitudinally cut in half having an internal diameter substantially the same as the outside diameter of said hose, said saddle having a curvature substantially similar to said curved plate surface.

12. The apparatus according to claim 11, wherein said pivoting clamp and said support member permit said hose to be installed without removal of said saddle.

13. The apparatus according to claim 9, wherein said apparatus further includes means for supporting and guiding the movement of said lances within said housing.

14. The apparatus according to claim 13, wherein said support and guide means comprises:

a first guide plate having a plurality of apertures adapted to support said lances, said first guide place being interposed proximate to said housing second end;

a plurality of guide tubes, said guide tubes being removably attached to said first guide plate and radially offset from said first guide plate to permit said lances to pass therethrough; and a second guide plate having a plurality of apertures corresponding to the tube bundle to be cleaned and adapted to be removably mounted on said second end of said elongate housing.

15. The apparatus according to claim 14, wherein said spool storage comprises:

a spool housing adapted to be removably connected to said elongate housing;

a spool rotatably mounted within said spool housing, said spool having a spindle, said spindle having a drive shaft on one end and a rotatable high pressure union mounted on the other end of said spindle, the second end of said hose being removably connected to said spool;

a plurality of idler rollers, said rollers being rotatably mounted within said spool housing and in proximity to said spool;

a drive gear mounted on the shaft of said spool spindle;

a hydraulic motor having an output shaft and a drive gear mounted on said shaft; and means for coupling the output of said hydraulic motor to said spool drive gear.

16. The apparatus according to claim 15, wherein said coupling means includes an endless drive chain for connecting said motor drive gear and said spool drive gear.

17. A multi-lance cleaning apparatus for cleaning the interior of vertically oriented heat exchanger tubes comprising:

an elongate hollow housing having first and second ends;

a hollow manifold slidably moveable within said housing, said manifold having a plurality of interconnected channels and outlets;

a conduit for connecting said manifold with a high pressure, high volume fluid source;

a spool for storage of said conduit to permit said conduit to advance and retract, said spool storage being in close proximity to said first end of said housing;

means for securing and supporting said conduit to said spool;

means for moving said manifold within said housing from a first retracted position to a second extended position;

a plurality of hollow tubular lances, the outer diameter of each said lance being adapted to fit within a heat exchanger tube, said lance having a first end and a second end, said first end of each of said lances being removably attached to said manifold and in communication with said fluid source, said second end of said lance being in proximity to said second end of said housing, said lances moving in response to the movement of said manifold;

means for supporting and guiding the movement of said lances; and means for vertically suspending said housing and spool storage above the heat exchanger tubes, such that said lances may be selectively advanced down into the heat exchanger tubes.

18. The apparatus according to claim 17, wherein said means for securing and supporting said hose includes:

a box-like structure attached to the interior of said spool, said box-like structure having a curved plate surface;

a saddle having a first end and a second end, said first end including a pivoting clamp which is attached to said box-like structure and said second end including a support member which is slidably attached to said spool; and wherein said hose rests in said saddle and is secured and supported between said curved plate surface and said saddle.

19. The apparatus according to claim 18, wherein said saddle comprises a pipe longitudinally cut in half having an internal diameter substantially the same as the outside diameter of said hose, said saddle having a curvature substantially similar to said curved plate surface.

20. The apparatus according to claim 19, wherein said pivoting clamp and said support member permit said hose to be installed without removal of said saddle.

* * * * *

UNITED STATES PATENT AND TRADEMARK OFFICE

CERTIFICATE OF CORRECTION

PATENT NO. : 5,067,558

DATED : November 26, 1991

INVENTOR(S) : Thomas B. Boisture and George E. Messer

It is certified that error appears in the above-identified patent and that said Letters Patent is hereby corrected as shown below:

On the Title page, item [75]m add --George E. Messer, Baytown, Tex.--

Column 9, line 28, cancel "12" and insert --126--.

Signed and Sealed this

Twenty-seventh Day of April, 1993

*Attest:*

MICHAEL K. KIRK

*Attesting Officer*

*Acting Commissioner of Patents and Trademarks*